United States Patent [19]

Lange et al.

[11] Patent Number: 5,011,578

[45] Date of Patent: Apr. 30, 1991

[54] EXTENDED NIP PRESS APPARATUS WITH BLANKET EDGE SEALS

[75] Inventors: David V. Lange, Beloit; Scott E. Filzen, Eau Claire, both of Wis.

[73] Assignee: Beloit Corporation, Beloit, Wis.

[21] Appl. No.: 602,602

[22] Filed: Oct. 24, 1990

[51] Int. Cl.[5] ..... D21F 3/02

[52] U.S. Cl. ..... 162/358; 100/153; 162/272

[58] Field of Search ..... 162/358, 205, 272, 361; 100/118, 153, 154; 29/116.1

[56] References Cited

U.S. PATENT DOCUMENTS

| | | | |
|---|---|---|---|
| 4,861,434 | 8/1989 | Bonander et al. | 162/358 |
| 4,919,761 | 4/1990 | Schiel et al. | 162/358 |
| 4,944,089 | 7/1990 | Flamig et al. | 29/116.1 |
| 4,975,152 | 12/1990 | Filzen et al. | 162/358 |

*Primary Examiner*—Karen M. Hastings

*Attorney, Agent, or Firm*—Dirk J. Veneman; Raymond Campbell; David J. Archer

[57] ABSTRACT

An extended nip press apparatus is disclosed for pressing water from a web of paper. The press includes a blanket which defines an endless loop and a first and a second lateral edge. Edge seals cooperate with the edges for sealing the edges of the blanket against egress of lubricant disposed between the shoe and the blanket. The edge seals include a head rotatably secured to a frame and an extension which extends from the head. The extension cooperates with the first edge of the blanket and defines a duck's bill configuration in a cross-machine sectional view such that the first edge of the blanket conforms to a surface defined by the extension. The surface has a first portion which undulates radially away from the head in an outward direction, and a second portion which undulates radially inwardly towards the head in an outward direction. A clamp adjustably secures the first edge of the blanket to the extension so that flow of lubricant from between the shoe and the blanket past the head is inhibited.

3 Claims, 2 Drawing Sheets

EXTENDED NIP PRESS APPARATUS WITH BLANKET EDGE SEALS

BACKGROUND OF THE INVENTION

1. Field of the Invention

The present invention relates to an extended nip press apparatus for pressing water from a web of paper. More particularly, the present invention relates to an "Apple" type enclosed extended nip press in which lubricant disposed between the shoe and the blanket is enclosed or contained within the blanket.

2. Information Disclosure Statement

An extended nip press is a press for a papermaking machine which increases the residence time of a web during passage of the web through a pressing nip.

More particularly, an extended nip press typically includes a backing roll and an elongate shoe which defines a concave surface that cooperates with the backing roll to define therebetween an elongate pressing nip. A bearing blanket is slidably disposed between the shoe and the backing roll such that the blanket is permitted to move in an endless loop through the pressing nip. A web to be pressed extends through the pressing nip and is sandwiched between the blanket and the backing roll such that the web is exposed for an extended period to increased pressure during passage of the web through the pressing nip.

In view of the movement of the blanket through the pressing nip and around the elongate shoe, the path of the blanket defines an "Apple" shaped configuration.

In order to permit the blanket to slide relative to the elongate shoe, lubricating oil is supplied between the concave surface of the shoe and the inner surface of the blanket.

The outer surface of the blanket either directly contacts the web or, more usually, contacts a press felt so that the web is disposed between the press felt and the backing roll.

In operation of the so-called "Apple" type extended nip press of the type disclosed in U.S. Pat. No. 4,287,021 to Justus et al, a problem of oil contamination of the web exists.

More particularly, there exists a tendency for the lubricating oil disposed between the shoe and the blanket to creep around the edges of the blanket so that such lubricating oil marks the press felt and the web.

Furthermore, such oil tends to atomize and subsequently settle as an oily film on ancillary equipment.

Such oily film not only causes a potential hazard in the form of slippery walkways and access ladders, but also poses a potential fire hazard in that the atomized oil droplets have a relatively low flash point.

Many proposals have been presented in an attempt to prevent the egress of lubricating oil from an apple type ENP. However, such proposals have often included relatively complex sealing arrangements, including compression springs, seal rings, and the like.

Included among such prior art proposals is U.S. Pat. No. 4,944,089 to Flamig et al issued July 31, 1990.

The present invention provides a very simple sealing arrangement for sealing the respective edges of a bearing blanket so that lubricating oil is prevented from seeping outwardly around the edges of the blanket, thereby inhibiting contamination of the pressed web.

Therefore, it is a primary objective of the present invention to provide an extended nip press apparatus which overcomes the aforementioned inadequacies of the prior art arrangements and which make a considerable contribution to the art of pressing water from a web of paper.

Another object of the present invention is the provision of an extended nip press which includes edge seal means which cooperate with the edges of a bearing blanket for sealing the edges of the blanket against egress of lubricant disposed between a shoe and the blanket.

Another object of the present invention is the provision of an extended nip press apparatus which includes edge seal means having a head rotatably secured to a frame and an extension which extends from the head, the extension cooperating with a first edge of the blanket. The extension defines a duck's bill configuration in a cross-machine sectional view such that the first edge of the blanket conforms to a surface defined by the extension. The surface has a first portion which undulates radially away from the head in an outward direction, and a second portion which undulates radially inwardly towards the head in an outward direction.

Another object of the present invention is the provision of an extended nip press apparatus which includes clamp means adjustably secured to the extension for clamping the first edge of the blanket to the extension. The clamp means defines a tapered surface which cooperates with the first edge such that the first edge is clamped between the tapered surface and the second portion. The arrangement is such that flow of lubricant from between the shoe and the blanket past the head is inhibited.

Another object of the present invention is the provision of an extended nip press apparatus which includes edge seal means having a further head rotatably secured to a frame, the further head having an outside diameter which is less than the outside diameter of the head. The arrangement is such that axial fitting of the blanket and the extensions over the further head is permitted.

Other objects and advantages of the present invention will be readily apparent to those skilled in the art by a consideration of the detailed description contained hereinafter taken in conjunction with the annexed drawings.

SUMMARY OF THE INVENTION

The present invention relates to an extended nip press apparatus for pressing water from a web of paper. The press apparatus includes a press frame and a backing roll rotatably supported relative to the frame. An elongate shoe defines a concave surface with the concave surface cooperating with the backing roll for defining therebetween an extended nip for the passage therethrough of the web. A bearing blanket defines an endless loop with the blanket extending through the nip such that the web is disposed between the blanket and the backing roll. The blanket also defines a first and a second lateral edge, the edges being spaced relative to each other. Edge seal means cooperate with the edges of the blanket for sealing the edges of the blanket against egress of lubricant disposed between the shoe and the blanket.

The edge seals means include a head rotatably secured to the frame. An extension extends from the head with the extension cooperating with the first edge of the blanket. The extension defines a duck's bill configuration in a cross-machine sectional view such that the first edge of the blanket conforms to a surface defined by the extension.

More particularly, the surface has a first portion which undulates radially away from the head in an outward direction. The surface also includes a second portion which undulates radially inwardly towards the head in an outward direction.

Clamp means are adjustably secured to the extension for clamping the first edge of the blanket to the extension. The clamp means defines a tapered surface which cooperates with the first edge such that the first edge is clamped between the tapered surface and the second portion so that flow of lubricant from between the shoe and the blanket past the head is inhibited.

In a more specific embodiment of the present invention, the apparatus further includes an annular flange which is defined by the extension. A peripheral rim extends from the head such that the rim cooperates with the flange. Securing means secures the flange to the rim.

The edge seal means also includes a further head rotatably secured to the frame. The further head has an outside diameter which is less than the outside diameter of the head. A further extension cooperates with the second edge of the blanket with the further extension defining a duck's bill configuration in a cross-machine sectional view. The arrangement is such that the second edge of the blanket conforms to a further surface defined by the further extension. The further surface has a further first portion which undulates radially away from the further head in an outward direction. The further surface also has a further second portion which undulates radially inwardly towards the further head in an outward direction.

A further clamp means is adjustably secured to the further extension for clamping the second edge of the blanket to the further extension. The further clamp means defines a further tapered surface which cooperates with the second edge. The arrangement is such that the second edge is clamped between the further tapered surface and the further second portion so that flow of lubricant from between the shoe and the blanket past the further head is inhibited.

A further annular flange is defined by the further extension, and a further peripheral rim extends from the further head.

Additionally, a further securing means secures the further flange to the further rim so that when the extension and the further extension are clamped relative to the respective edges of the blanket, the blanket and the extension are permitted to be fitted axially over the further head.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
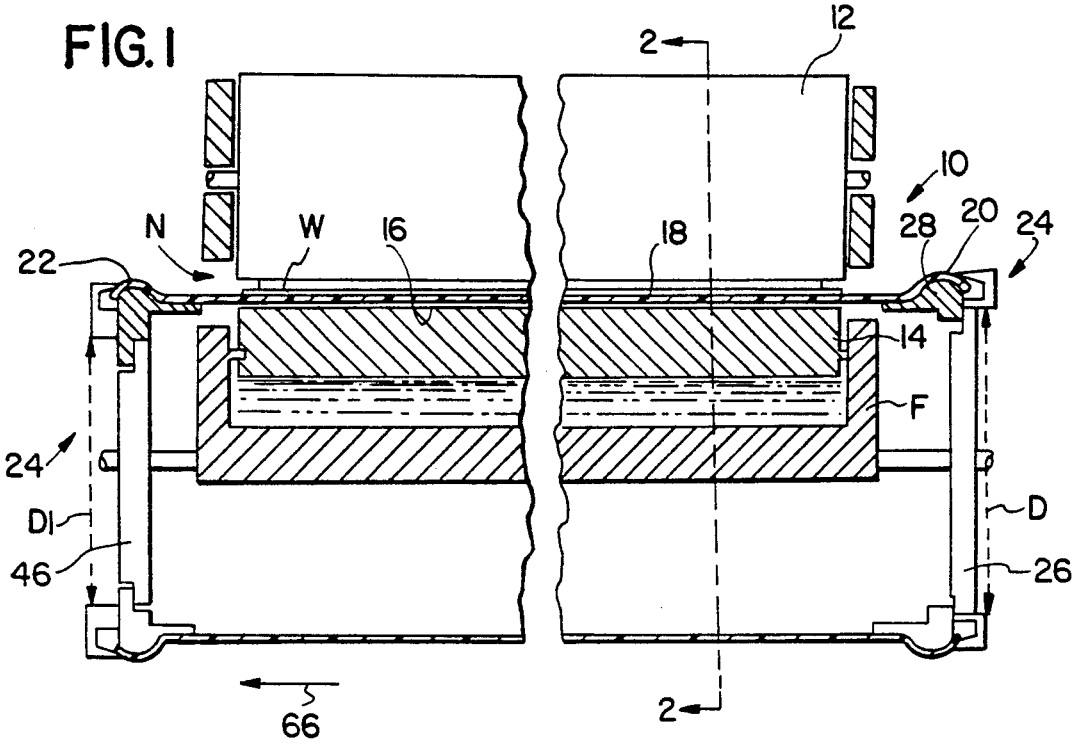
FIG. 1 is a sectional view of an extended nip press apparatus according to the present invention showing the extensions having a duck's bill configuration.

FIG. 1 is a sectional view of an extended nip press apparatus generally designated 10, according to the present invention, for pressing water from a web of paper W. The press apparatus 10 includes a press frame F. A backing roll 12 is rotatably supported relative to the frame F. An elongate shoe 14 defines a concave surface 16 with the concave surface 16 cooperating with the backing roll 12 for defining therebetween an extended nip N for the passage therethrough of the web W.

A blanket 18 defines an endless loop with the blanket 18 extending through the nip N such that the web W is disposed between the blanket 18 and the backing roll 12. The blanket 18 further defines a first and a second lateral edge 20 and 22 respectively. The edges 20 and 22 are spaced relative to each other.

Edge seal means generally designated 24 cooperate with the edges 20 and 22 of the blanket 18 for sealing the edges 20 and 22 against egress of lubricant (not shown) disposed between the shoe 14 and the blanket 18.

Figure 2:
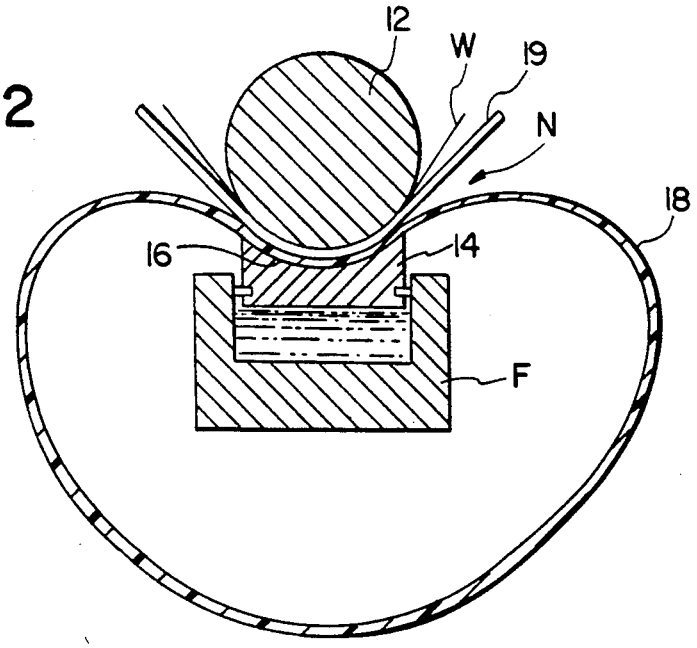
FIG. 2 is a sectional view taken on the line 2—2 of FIG. 1.

FIG. 2 is a sectional view taken on the line 2—2 of FIG. 1 showing the "Apple" shape configuration of the blanket 18.

Figure 3:
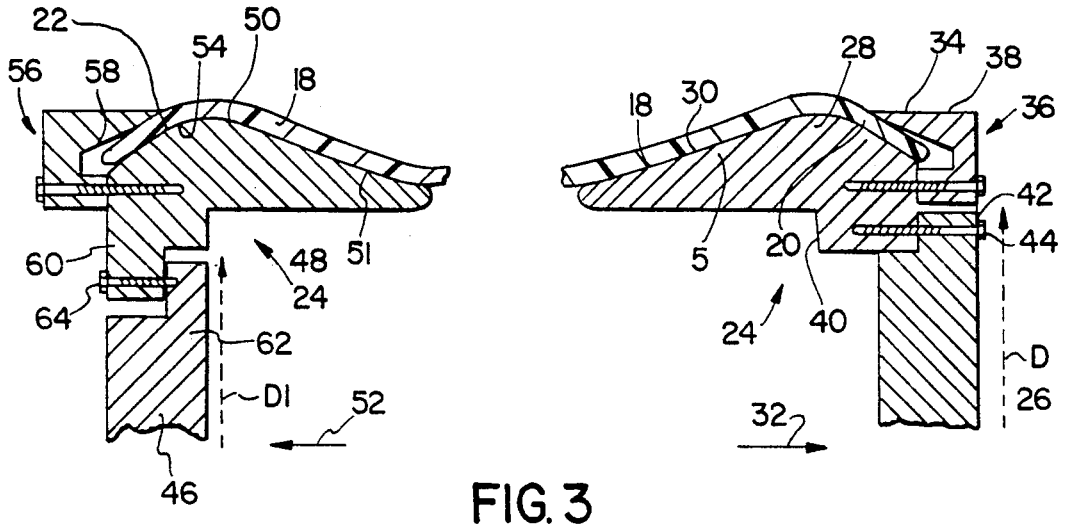
FIG. 3 is an enlarged fragmentary view of the press apparatus according to the present invention showing the extensions, the edges of the blanket and portions of the heads.

FIG. 3 is an enlarged fragmentary view in section of the edge seal means 24.

More particularly, the edge seal means 24 includes a head 26 rotatably secured to the frame F. An extension 28 extends from the head 26. The extension 28 cooperates with the first edge 20 of the blanket 18. The extension 28 defines a duck's bill configuration in a cross-machine sectional view, as shown in FIG. 3, such that the first edge 20 of the blanket 18 conforms to a surface S defined by the extension 28. The surface S has a first portion 30 which undulates radially away from the head 26 in an outward direction, and a second portion 34 which undulates radially inwardly towards the head 26 in an outward direction. The outward direction is shown by the arrow 32 in FIG. 3.

Clamp means generally designated 36 is adjustably secured to the extension 28 for clamping the first edge 20 of the blanket 18 to the extension 28. The clamp means 36 defines a tapered surface 38 which cooperates with the first edge 20 such that the first edge 20 is clamped between the tapered surface 38 and the second portion 34 so that flow of lubricant from between the shoe 14 and the blanket 18 past the head 26 is inhibited.

Referring back more specifically to FIG. 2, FIG. 2 is a sectional view taken on the line 2—2 of FIG. 1 and shows the backing roll 12 and the elongate shoe 14 defining the concave surface 16. The concave surface 16 cooperates with the backing roll 12 for defining therebetween the extended nip N for the passage therethrough of the web W. FIG. 2 also shows the disposition of a press felt 19 disposed between the web W and the blanket 18 for absorbing water pressed from the web W during passage of the web W through the extended nip N.

As shown more specifically in FIG. 3, the extension 28 also includes an annular flange 40 defined by the extension 28. A peripheral rim 42 extends from the head 26 so that the rim 42 cooperates with the flange 40. Securing means 44, such as bolts, secures the flange 40 to the rim 42.

FIG. 3 shows further details of the edge seal means 24. The edge seal means 24 includes a further head 46, as shown in FIGS. 1 and 3. The further head 46 is rotatably secured to the frame F. The further head 46 has an outside diameter D1 which is less than the outside diameter D of the head 26 as shown in FIG. 1. A further extension 48 cooperates with the second edge 22 of the blanket 18. The further extension 48 defines a duck's bill configuration in a cross-machine sectional view as shown in FIG. 3 such that the second edge 22 of the blanket 18 conforms to a further surface S1 defined by the further extension 48. The further surface S1 has a further first portion 50 which undulates radially away from the further head 46 in a further outward direction. The further outward direction is indicated by the arrow 52. The surface S1 also includes a further second portion 54 which undulates radially inwardly towards the further head 46 in an outward direction 52.

A further clamp means 56 is adjustably secured to the further extension 48 for clamping the second edge 22 of the blanket 18 to the further extension 48. The further clamp means 56 defines a further tapered surface 58 which cooperates with the second edge 22 such that the second edge 22 is clamped between the further tapered surface 58 and the further second portion 54 so that flow of lubricant from between the shoe 14 and the blanket 18 past the further head 46 is inhibited.

More specifically, as shown in FIG. 3, a further annular flange 60 is defined by the further extension 48. Furthermore, a further peripheral rim 62 extends from the further head 46.

Also, a further securing means 64 secures the further flange 60 to the further rim 62. The arrangement is such that when the extension 28 and the further extension 48 are clamped relative to the respective edges 20 and 22 of the blanket 18, the extensions 28 and 48 are permitted to be fitted axially, as indicated by the arrow 66, over the heads 46 and 26 respectively, as shown in FIG. 4.

Figure 4:
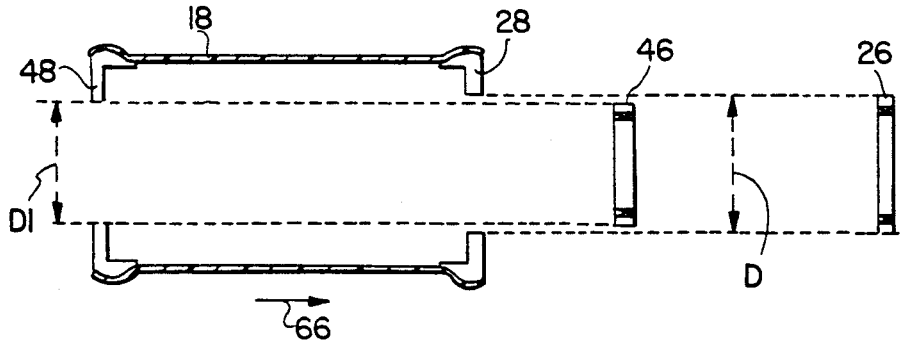
FIG. 4 is a diagrammatic representation of the blanket secured to the extensions and showing how the combination is moved axially over the respective heads.

FIG. 4 shows how the combination of the blanket 18 and extensions 28 and 48 are fitted axially over the heads 46 and 26 as indicated by the arrow 66.

In operation of the extended nip press apparatus 10, as shown in FIGS. 1 to 4, when the blanket 18 is to be removed from the press apparatus 10, the securing means 44 and 64 are released so that the extensions 28 and 48 are detached from the heads 26 and 46. The blanket 18, together with the extensions 28,48 and clamping means 36,56, are then pulled axially, in the opposite direction to that shown by the arrow 66, so that the blanket 18 and the extension 28, together with the clamp means 36, slide over the shoe 14 when retracted and then over the peripheral rim 62 of the head 46.

The present invention provides a simple and inexpensive means for sealing an enclosed extended nip press against the egress of lubricating oil disposed between the shoe and the blanket.

Also, the present invention provides a simple means for removing a blanket axially from a press apparatus without requiring complex disassembly of the edge seal means.

What is claimed is:

1. An extended nip press apparatus for pressing water from a web of paper, said press apparatus comprising:

a press frame;

a backing roll rotatably supported relative to said frame;

an elongate shoe defining a concave surface, said concave surface cooperating with said backing roll for defining therebetween an extended nip for the passage therethrough of the web;

a blanket defining an endless loop, said blanket extending through said nip such that the web is disposed between said blanket and said backing roll, said blanket further defining a first and second lateral edge, said edges being spaced relative to each other;

edge seal means cooperating with said edges for sealing said edges of said blanket against egress of lubricant disposed between said shoe and said blanket;

said edge seal means including:

a head having an outside diameter and being rotatably secured to said frame;

an extension which extends from said head, said extension cooperating with said first edge of said blanket, said extension defining a duck's bill configuration in a cross-machine sectional view, such that said first edge of said blanket conforms to a surface defined by said extension, said surface having a first portion which undulates radially away from said head in an outward direction and a second portion which undulates radially inwardly towards said head in an outward direction; and clamp means adjustably secured to said extension for clamping said first edge of said blanket to said extension, said clamp means defining a tapered surface which cooperates with said first edge such that said first edge is clamped between said tapered surface and said second portion so that flow of said lubricant from between said shoe and said blanket past said head is inhibited.

2. An extended nip press apparatus as set forth in claim 1 further including:

an annular flange defined by said extension;

a peripheral rim extending from said head, said rim cooperating with said flange;

securing means for securing said flange to said rim.

3. An extended nip press apparatus as set forth in claim 1 wherein said edge seal means includes:

a further head rotatably secured to said frame, said further head having an outside diameter less than the outside diameter of said head;

a further extension which cooperates with said second edge of said blanket, said further extension defining a duck's bill configuration in a cross-machine sectional view, such that said second edge of said blanket conforms to a further surface defined by said further extension, said further surface having a further first portion which undulates radially away from said further head in an outward direction and a further second portion which undulates radially inwardly towards said further head in an outward direction;

further clamp means adjustably secured to said further extension for clamping said second edge of said blanket to said further extension, said further clamp means defining a further tapered surface which cooperates with said second edge such that said second edge is clamped between said further tapered surface and said further second portion so that flow of said lubricant from between said shoe and said blanket past said further head is inhibited;

a further annular flange defined by said further extension;

a further peripheral rim extending from said further head; and further securing means for securing said further flange to said further rim, the arrangement being such that when said extension and said further extension are clamped relative to the respective edges of said blanket, said blanket and said extensions are permitted to be fitted axially over said heads.

* * * * *